US007748117B2

(12) United States Patent
Pizzi

(10) Patent No.: US 7,748,117 B2
(45) Date of Patent: Jul. 6, 2010

(54) METHOD FOR PRODUCING MOVABLE CONTACT PARTS WITH FLAT PINS AND CONTACT PARTS MADE USING THIS METHOD

(75) Inventor: Giordano Pizzi, Milan (IT)

(73) Assignee: Morsettitalia, S.p.A., Milan (IT)

( * ) Notice: Subject to any disclaimer, the term of this patent is extended or adjusted under 35 U.S.C. 154(b) by 118 days.

(21) Appl. No.: 12/026,369

(22) Filed: Feb. 5, 2008

(65) Prior Publication Data

US 2008/0184560 A1 Aug. 7, 2008

(30) Foreign Application Priority Data

Feb. 5, 2007 (IT) ..... MI2007A0186

(51) Int. Cl.
*H01R 43/04* (2006.01)

(52) U.S. Cl. ..... 29/883; 29/882; 29/874; 29/876; 439/620.15; 439/620.26; 264/272.15; 264/272.17

(58) Field of Classification Search ..... 29/882; 439/620.15, 620.26–620.34; 264/272.15, 264/272.17
See application file for complete search history.

(56) References Cited

U.S. PATENT DOCUMENTS 2,045,847 A 6/1936 Fotsch
2,082,947 A 6/1937 Fotsch
3,159,730 A 12/1964 Staffel
3,609,642 A 9/1971 Norden
3,665,376 A 5/1972 Paris et al.
3,751,579 A 8/1973 Nojiri
3,775,733 A 11/1973 Ege
3,840,781 A * 10/1974 Brown ..... 361/58
4,070,086 A 1/1978 Trafford
4,171,861 A 10/1979 Hohorst
4,203,200 A * 5/1980 Wiebe ..... 29/623
4,224,592 A * 9/1980 Urani et al. ..... 337/198
4,241,975 A 12/1980 Cooper, Jr.
4,340,270 A 7/1982 Wilmes et al.
4,350,407 A * 9/1982 Tong ..... 439/490
4,365,396 A * 12/1982 Baba et al. ..... 445/22
4,391,485 A 7/1983 Urani
4,559,504 A 12/1985 Krec
4,795,997 A * 1/1989 Fisher et al. ..... 337/380

(Continued)

FOREIGN PATENT DOCUMENTS

DE 3339365 A1 5/1985

(Continued)

OTHER PUBLICATIONS

European Search Report from EP08075059, dated, Aug. 24, 2009.

*Primary Examiner*—Derris H Banks
*Assistant Examiner*—Jeffrey Carley
(74) *Attorney, Agent, or Firm*—Mintz Levin Cohn Ferris Glovsky and Popeo, P.C.

(57) ABSTRACT

A method for producing electric contact parts includes the following stages: a) stamping a strip of electric conducting parts connected together in the longitudinal direction (X-X) by a continuous strip; b) inserting said strip inside a mould; c) over-moulding the conducting parts with insulating material depending on the final form envisaged for the electric contact part; d) cutting the continuous strip in the region of the flat pins; e) extracting the finished parts.

24 Claims, 2 Drawing Sheets

U.S. PATENT DOCUMENTS

| | | | | |
|---|---|---|---|---|
| 4,889,504 | A | 12/1989 | Barbier et al. | |
| 4,940,431 | A | 7/1990 | Hennemann | |
| 5,002,505 | A * | 3/1991 | Jones et al. | 439/620.29 |
| 5,030,131 | A | 7/1991 | Boehm | |
| 5,243,139 | A | 9/1993 | Law | |
| 5,276,280 | A | 1/1994 | Ball | |
| 5,328,392 | A | 7/1994 | Lin et al. | |
| 5,454,730 | A | 10/1995 | Tozuka | |
| 5,553,787 | A | 9/1996 | Guginsky | |
| 5,564,941 | A | 10/1996 | Norden | |
| 5,766,044 | A | 6/1998 | Norden | |
| 5,853,304 | A | 12/1998 | Landreau et al. | |
| 5,860,837 | A | 1/1999 | Bock et al. | |
| 5,905,230 | A | 5/1999 | Marik | |
| 5,915,998 | A | 6/1999 | Stidham et al. | |
| 6,004,167 | A | 12/1999 | Hirakawa | |
| 6,157,287 | A | 12/2000 | Douglass et al. | |
| 6,475,038 | B1 | 11/2002 | Franck | |
| 6,786,779 | B2 | 9/2004 | Feldmeier et al. | |
| 7,101,231 | B2 | 9/2006 | Prokup et al. | |
| 7,385,518 | B2 | 6/2008 | Torrez et al. | |
| 7,413,486 | B2 | 8/2008 | Pizzi | |
| 7,438,606 | B2 | 10/2008 | Pizzi | |
| 7,500,889 | B2 | 3/2009 | Pizzi | |
| 2002/0067279 | A1 | 6/2002 | Torrez et al. | |
| 2005/0042912 | A1 | 2/2005 | Drewes et al. | |
| 2005/0221665 | A1 | 10/2005 | Otto et al. | |
| 2006/0128232 | A1 | 6/2006 | Kim | |
| 2006/0148302 | A1 | 7/2006 | Patel et al. | |
| 2006/0228950 | A1 | 10/2006 | Jamaleddin et al. | |
| 2007/0159292 | A1 * | 7/2007 | Chang et al. | 337/159 |
| 2008/0242150 | A1 * | 10/2008 | Chikamatsu et al. | 439/620.3 |

FOREIGN PATENT DOCUMENTS

| | | | |
|---|---|---|---|
| DE | 3621071 | A1 | 1/1987 |
| DE | 3629796 | C1 | 12/1987 |
| DE | 3805158 | A1 | 8/1989 |
| DE | 4223540 | A1 | 1/1994 |
| DE | 4409612 | A1 | 9/1994 |
| DE | 19530947 | A1 | 1/1997 |
| DE | 19542628 | C1 | 2/1997 |
| DE | 19729327 | C1 | 10/1998 |
| DE | 29921080 | | 4/2001 |
| DE | 10010719 | C1 | 8/2001 |
| DE | 102004018553 | A1 | 11/2005 |
| EP | 0382999 | | 8/1990 |
| EP | 0678934 | A1 | 10/1995 |
| EP | 0893859 | A2 | 1/1999 |
| EP | 1137034 | A1 | 9/2001 |
| EP | 1137035 | A1 | 9/2001 |
| EP | 1381068 | A1 | 1/2004 |
| EP | 1798821 | A2 | 6/2007 |
| FR | 2259462 | A1 | 8/1975 |
| FR | 2529024 | A1 | 12/1983 |
| FR | 2637740 | A1 | 4/1990 |
| FR | 2766628 | A1 | 1/1999 |
| GB | 2342508 | A | 4/2000 |

* cited by examiner

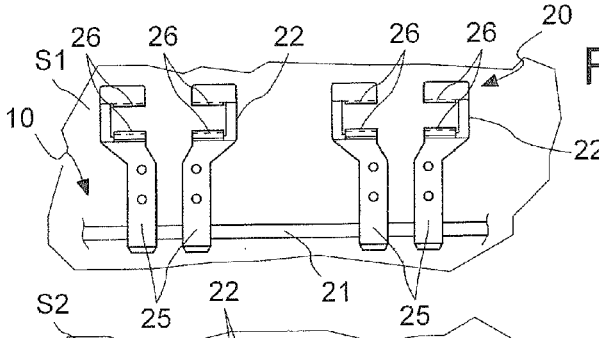
Fig.1
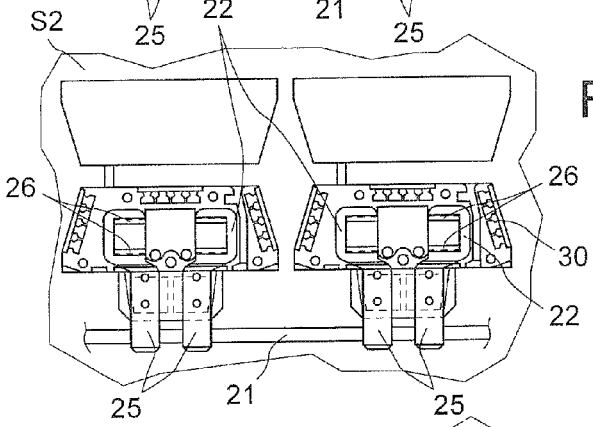
Fig.2
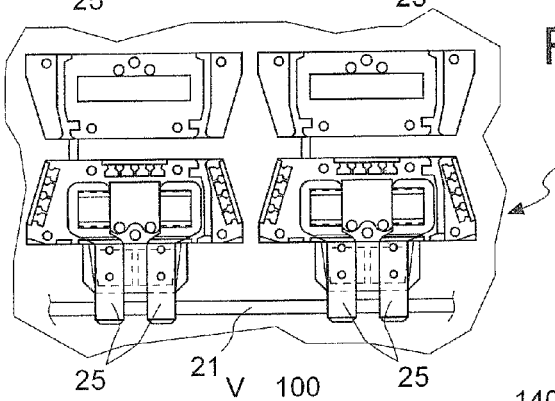
Fig.3
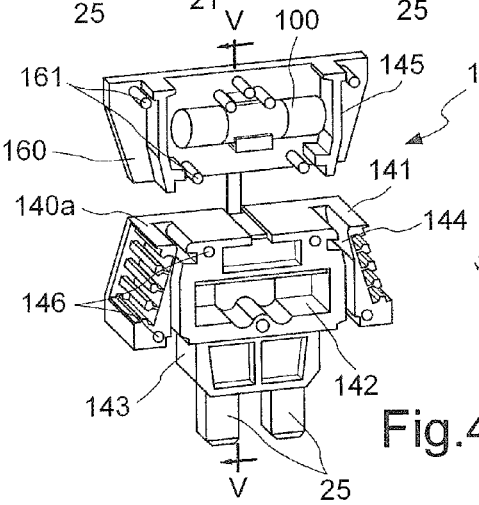
Fig.4
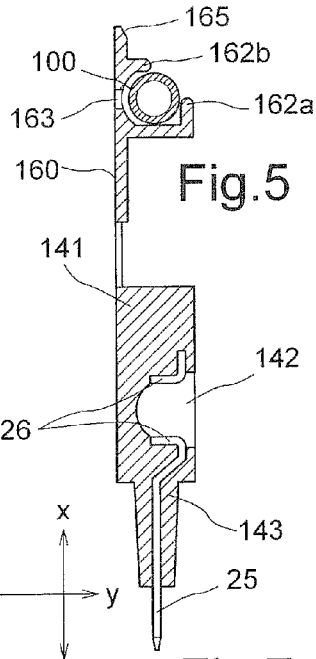
Fig.5
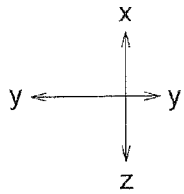
Fig.7
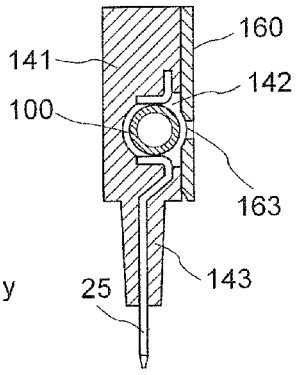
Fig.6
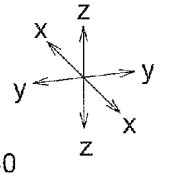
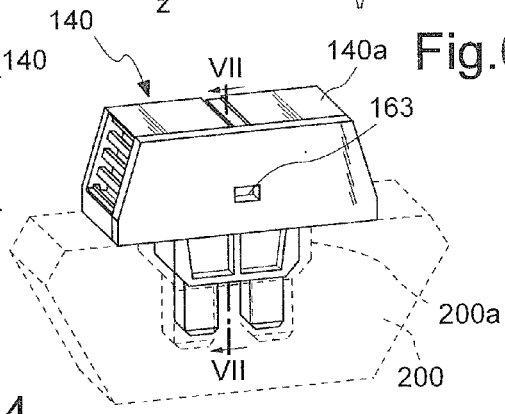

METHOD FOR PRODUCING MOVABLE CONTACT PARTS WITH FLAT PINS AND CONTACT PARTS MADE USING THIS METHOD

TECHNICAL FIELD OF THE INVENTION

The present invention relates to a method for producing electric contact parts which can be inserted into and removed from terminal blocks for connecting electric wires.

DESCRIPTION OF THE PRIOR ART

It is known in the technical sector relating to the design of distribution boards for the cables of electrical installations to use terminal blocks which can be mounted on associated supports and to provide at the front, access to the termnals—normally of the screw or spring type—for retaining the electric wires to be connected in order to restore the continuity of the circuit section; it is also known that this continuity is achieved by inserting into a special seat, which can be accessed frontally, movable contact parts such as protection fuses and/or electric circuit isolators and the like.

It is also known that these contact parts are at present made with flat conductor pins extending outwards and able to engage with corresponding retaining and contact parts inside the terminal block.

An example of these contact parts consists of a glass-fuse holder unit which must, however, be combined with a terminal block suitable for engagement of the pins; such units are in fact made according to the known art by means of assembly of various component parts, making production of the finished part particularly complicated, subject to errors and rejects, and therefore costly.

SUMMARY

The technical problem which is posed, therefore, is to provide a method for producing contact parts of the flat-pin type which is quick, repeatable and low-cost.

In connection with this problem it is also preferable that this method should allow the production of special contact parts such as flat-pin fuses, glass-fuse holder units with flat pins, flat-pin isolators and the like.

These results are achieved according to the present invention by a method for producing electric contact parts which can be inserted into and removed from wire connection terminal blocks, which comprises the following stages: a) stamping (S1) a strip of electrically conductive parts which are connected in the longitudinal direction (X-X) by a continuous strip; b) inserting said strip inside a mould (S2); c) over-moulding the conductive parts (20) with insulating material depending on the final form intended for the electric contact part; d) cutting the continuous strip in the region of the flat pins; e) extracting the finished parts.

BRIEF DESCRIPTION OF THE FIGURES

Further details may be obtained from the following description of a non-limiting example of embodiment of the subject of the present invention provided with reference to the accompanying drawings in which:

FIG. 1 shows a plan view of the first stage of the method according to the invention for producing a flat-pin glass-fuse holder;

FIG. 2 shows a plan view of the second stage of the method according to the invention;

FIG. 3 shows a plan view of the third stage of the method according to the invention;

FIG. 4 shows a perspective view of a flat-pin glass-fuse holder unit in the open condition;

FIG. 5 shows a cross-section along the plane indicated by the line V-V in FIG. 4;

FIG. 6 shows a perspective view of a flat-pin glass-fuse holder unit in the closed position;

FIG. 7 shows a cross-section along the plane indicated by the line VII-VII in FIG. VI;

DETAILED DESCRIPTION

Figure 8A:
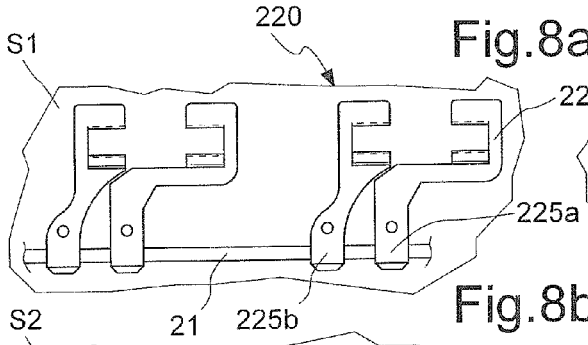
FIGS. 8*a*, 8*b* show a plan view of the first and second stage, respectively, of the method according to the invention for producing a flat-pin glass-fuse holder unit of the rotating type.

As shown in the drawings and assuming solely for the sake of convenience of the description and without a restrictive meaning a set of three reference axes, i.e. in the longitudinal direction X-X, transverse direction Y-Y and vertical direction Z-Z, the method according to the invention comprises the following stages:

a) as shown in FIG. 1, stamping S1 (preferably cold-stamping) a strip 10 of electric conducting parts 20 connected together in the longitudinal direction X-X by a continuous strip 21, preferably made of the same material as the flat pins;

b) as shown in FIG. 2, inserting said strip 10 inside a mould S2 preferably of the injection type;

c) over-moulding, symmetrically in the transverse direction Y-Y, the conducting parts 20 with insulating material 30 depending on the final form intended for the electric contact part 40;

d) as shown in FIGS. 3 and 4, cutting the strip 21 in the region of the flat pins 25 so as to free the single electric contacts 40;

e) extracting the finished parts.

As shown in FIGS. 1 to 7, the method according to the present invention may be applied so as to obtain a contact part 40 in the form of a casing 140 with flat pins 25 for holding a glass fuse 100.

In detail as shown in FIG. 1, the strip 10 is formed by a series of conducting parts 20 each formed by a flat pin 25 and a head 22 which is substantially C-shaped and has tongues 26 extending in the transverse direction Y-Y so as to form the seat and electrical contact for the ends of a fuse 100, said conducting parts 20 being arranged symmetrically, opposite each other at a relative distance equal to the length of the said fuse 100 measured in the longitudinal direction.

By means of the over-moulding stage as shown in FIG. 2, the conducting parts 20 are covered with insulating material 30 so as to form a casing 140 with flat pins 25 for holding a glass fuse 100, comprising:

a top part 141 substantially in the form of a parallelepiped and extending with its greater side in the longitudinal direction X-X and having, formed inside it, a seat 142 at the ends of which the oppositely arranged C-shaped heads 22 project so as to form the seat and electric contact for the glass fuse 100;

a bottom part 143 which is integral with the top part 141 and has a shape so as to cover partially the flat pins 25 and allow the insertion in a corresponding seat 200*a* of a terminal block 200 for connecting electric wires, shown in broken lines in FIG. 6.

As shown in FIGS. 3 and 4, the fuse-holder casing also has a suitably shaped cavity 144 which passes through the top part 141 in the vertical direction Z-Z; said cavity is suitable for engagement with a corresponding light indicator element 145 which is formed in relief on the cover 160 so as to render visible on the front surface 140*a* of the casing the luminous signal for correct/incorrect operation emitted by a corresponding signalling component (e.g. LED) which is incorporated in the terminal block 200.

Although not shown, alternatively, the light indicator element can be separate from the cover instead of being formed as one piece thereon.

The casing 140 also has a seat 147 which is arranged on the outer front side and is designed to house an information label.

The cover 160 is also provided with pins 161 extending in the transverse direction Y-Y and able to engage, with interference, in respective seats 146 in the top part 141 of the casing 140 for closing/opening thereof. The cover is also provided in a substantially central position with support elements 162*a* and 162*b* extending in the transverse direction Y-Y and designed to allow retention of the fuse 100 which in this way remains fixed to the cover 160 by means of which it is inserted into/removed from the associated seat 142 following closing/opening of said cover.

An inspection slit 163 is also provided into the cover 160 opposite the transparent zone of the fuse 100.

Along its free edge, said cover 160 has a tapered or flared lip 165 designed to facilitate opening thereof.

Figure 8B:
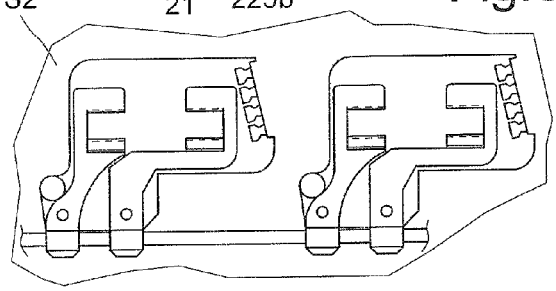
Figure 8C:
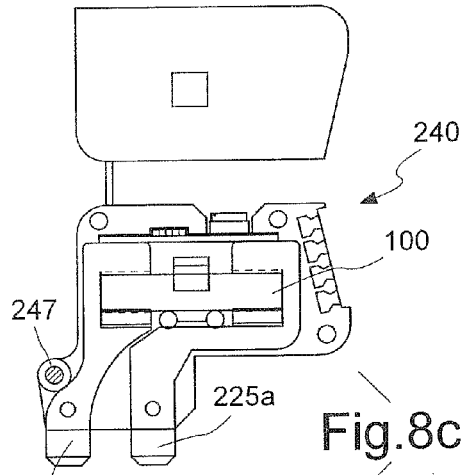
FIG. 8*c* shows a plan view of flat-pin glass-fuse holder units of the rotating type in the finished and open condition.

As shown in FIGS. 8*a*,8*b* and 8*c* the same method may also be applied in order to obtain a casing 240 for holding fuses 100 of the rotating type; in this case, the conducting parts 220 have similar C-shaped heads 222 arranged opposite each other (FIG. 8*a*), while the flat pins 225*a* and 225 are formed asymmetrically so that they are situated off-center with respect to a vertical axis of symmetry.

During over-moulding (FIG. 8*b*), in addition to the top casing 240 with an asymmetrical form, a pin 247 is also formed in a suitable position, projecting from both the sides of the casing in the transverse direction Y-Y, for insertion in corresponding transverse seats (not shown) of the wire connecting terminal block.

Figure 9:
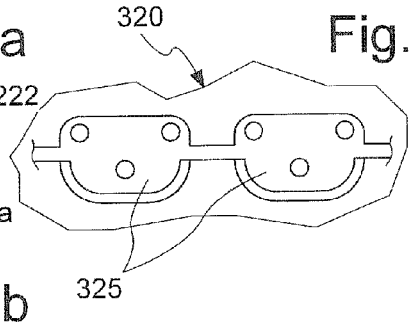
FIG. 9 shows a plan view of the first stage of the method according to the invention for producing an isolator.
Figure 10A:
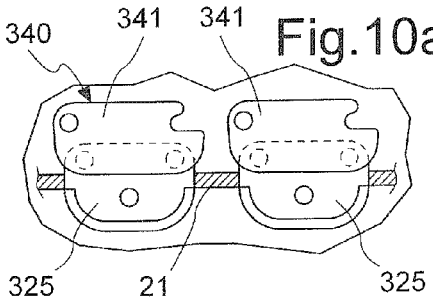
FIGS. 10*a*, 10*b* show a plan view of the second stage of the method and the finished rotating isolator, respectively.
Figure 10B:
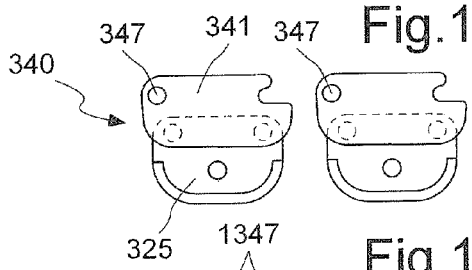
Figure 11A:
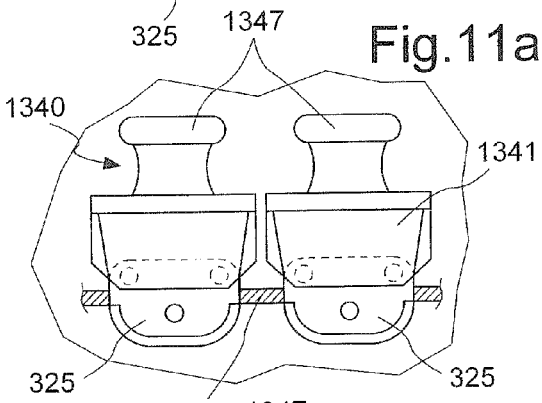
FIGS. 11*a*, 11*b* shows a plan view, respectively, of the second stage of the method and a finished flat-pin isolator.
Figure 11B:
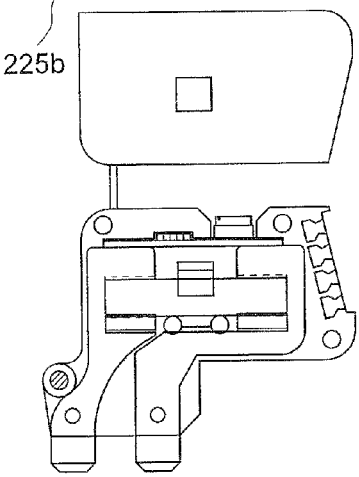
Figure 11B:
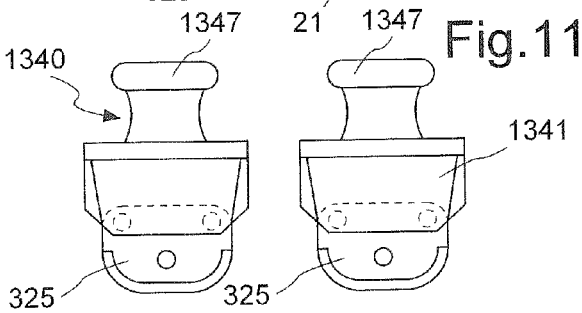

FIG. 9 illustrates a further mode of implementing the method, by means of which it is possible to obtain isolators 340; 1340 which are of the type for insertion by means of rotation (FIGS. 10*a*,10*b*) or displacement (FIGS. 11*a*, 11*b*), respectively.

In this case the strip 320 consists of suitably shaped flat pins 325 which are connected together by the strip 21 and which, during over-moulding, are partially covered either with a head 341 which has a transverse pin 347 (FIGS. 10*a*, 10*b*), for operation by means of rotation, or with a head 1341 which has a gripping part 1347, for applying a pushing/pulling force in order to insert/remove the contact part into/from the associated terminal block 200.

Said gripping part 1347 is also designed to be inserted inside the seat 200*a* of the terminal block in order to indicate visually incorrect operation thereof.

It is therefore clear how with the method according to the invention it is possible to produce movable contact parts for terminal blocks for connecting electric wires in a rapid, reliable and low-cost manner in particular in the case of flat-pin fuses or integrated glass-fuse holder units with a flat pin engaging system.

In addition to this, owing to the particular symmetrical form of the internal conducting part, it is possible to reduce the number of parts to be manufactured and stocked since the said part may be equally well used for right-hand or left-hand mounting by means of sole positioning inside the contact part.

Although illustrated with reference to a strip consisting of only two parts, the person skilled in the art may design the number of contacts in a strip or the associated moulds for large scale production which is economically advantageous.

The invention claimed is:

1. A method for producing electric contact parts which can be inserted into and removed from terminal blocks for connecting electric wires, the method comprising:

a) stamping a strip of electrically conducting parts, each part including at least one flat pin, the strip of electrically conducting parts being connected together in a longitudinal direction by a continuous strip;

b) inserting the strip of electrically conducting parts inside a mould;

c) over-moulding at least a portion of the conducting parts with insulating material whereby at least a portion of the flat pins remain exposed;

d) cutting the continuous strip in the region of the flat pins;

e) extracting the finished parts wherein at least one contact part includes a case adapted for holding a glass fuse and flat pins projecting from the case.

2. A method according to claim 1, wherein the continuous strip is made of the same material as the flat pins.

3. A method according to claim 1, wherein the insulating material is moulded symmetrically with respect to the conducting pins in a transverse direction.

4. A method according to claim 1, wherein stamping of the electrically conducting parts includes cold-stamping.

5. A method according to claim 1, wherein over-moulding includes injection moulding.

6. A method according to claim 1, wherein the strip of electrically conducting parts includes a series of separate conducting parts, each conducting part including a flat pin and a substantially C-shaped head.

7. A method according to claim 6, wherein the C-shaped head includes at least one tongue extending in a transverse direction and forming a seat adapted to make contact with an end of a fuse.

8. A method according to claim 6, wherein the contacting parts include at least two conducting parts arranged symmetrically opposite each other at a relative distance equal to a length of the fuse in a longitudinal direction.

9. A method according to claim 1, wherein the case includes a top part which is substantially in the form of a parallelepiped extending with its greater side in a longitudinal direction; and a bottom part integral with the top part and extending over a portion of the electrically conducting parts, at least partially covering the flat pins.

10. A method according to claim 9, wherein the case includes:

a seat is formed inside the top part, the seat including the C-shaped heads oppositely arranged in the seat forming a seat and contact for the glass fuse.

11. A method according to claim 9, wherein the bottom part is formed of a shape suitable for insertion in a corresponding seat of a terminal block for connecting electric wires.

12. A method according to claim 9, wherein the top part includes a cavity which passes through the top part in a vertical direction.

13. A method according to claim 12, wherein the cavity is adapted to contain a light indicator element.

14. A method according to claim 13, wherein the light indicator element is formed in the cover.

15. A method according to claim 13, wherein the light indicator element is separate from the cover.

16. A method according to claim 1, wherein the case has a cover that can be opened and closed.

17. A method according to claim 16, wherein the cover includes pins extending in a transverse direction and adapted to engage respective seats in the top part of the case.

18. A method according to claim 16, wherein the cover includes support elements extending in a transverse direction and adapted for retaining the fuse.

19. A method according to claim 16, wherein the cover includes an opening for inspecting the fuse.

20. A method according to claim 16, wherein the cover includes a tapered or flared lip along a free edge to facilitating opening.

21. A method according to claim 16, wherein the case includes a seat, arranged on an outer front side, adapted to receive an information label.

22. A method according to claim 1, wherein the case is adapted to be inserted in a wire connecting terminal block by rotation.

23. A method according to claim 22, wherein the conducting parts include oppositely arranged C-shaped heads and flat pins arranged asymmetrically with respect to a vertical axis of symmetry.

24. A method according to claim 23, wherein the case includes a pin projecting from both the sides of the case in a transverse direction and is adapted for insertion in corresponding seats of a wire connecting terminal block.

* * * * *